United States Patent [19]

Combeau

[11] 4,314,504

[45] Feb. 9, 1982

[54] PAD TRANSFER PRINTING MACHINE

[75] Inventor: Guy Combeau, Paris, France

[73] Assignee: Machines Dubuit, Paris, France

[21] Appl. No.: 117,552

[22] Filed: Feb. 1, 1980

[30] Foreign Application Priority Data

Feb. 1, 1979 [FR] France ..... 79 02655

[51] Int. Cl.[3] ..... B41F 1/16; B41F 17/00

[52] U.S. Cl. ..... 101/41; 101/163

[58] Field of Search ..... 101/41, 42, 43, 44, 101/163, 164, 165, 193, 287, 292

[56] References Cited

U.S. PATENT DOCUMENTS 4,060,031 11/1977 Philipp ..... 101/141 X
4,216,718 8/1980 Gaston ..... 101/247

FOREIGN PATENT DOCUMENTS 2334179 1/1975 Fed. Rep. of Germany ..... 101/41
2057947 5/1971 France .
888611 1/1962 United Kingdom .
907109 10/1962 United Kingdom ..... 101/41
911534 11/1962 United Kingdom ..... 101/41
1537017 12/1978 United Kingdom .

*Primary Examiner*—J. Reed Fisher
*Attorney, Agent, or Firm*—Charles E. Brown

[57] ABSTRACT

A printing machine using the 'Bienne transfer' process, comprising a pad-holder carriage and a plate-holder carriage which, for their horizontal movement, are connected to links respectively coupled themselves to a control rod subjected to pivotal reciprocating motion about a fixed pivot under the action of a pneumatic actuator.

11 Claims, 10 Drawing Figures

PAD TRANSFER PRINTING MACHINE

The present invention generally relates to printing machines using the process known as "Bienne transfer".

It is known that a machine of this type utilizes a printing plate which with each operating cycle is suitably inked by a doctor and doctor-support assembly, and an elastically deformable printing pad which, during such a cycle, is successively applied against said printing plate, so as to take therefrom the ink deposited on it, then against an object to be printed so as to deposit thereon the ink previously taken from the printing plate.

A relative horizontal movement is thus necessary between the printing plate and the printing pad, independently of the reciprocating vertical movement of the printing pad with respect to the printing plate.

In some machines, and this is particularly the case in that described in the French patent registered on July 28, 1970 under No. 70 29106, published as No. 2.057 947, the printing plate is fixed and the printing pad is movable.

In other machines, and this is the case in particular in German patent application No. 2.334.179, the printing pad is fixed, whereas the printing plate is movable.

In other machines, and this is the case in GB Pat. No. 907.109, the printing plate and the printing pad are both movable, which makes it possible to reduce their relative travel.

Finally, in other machines, and this is the case in GB Pat. No. 911.534, the plate-holder carriage and pad-holder carriage are both movable by means of control means common to said carriages.

The present invention relates in particular to a machine of this latter type.

Therefore, this machine is of the type comprising a plate-holder carriage mounted for horizontal movement, for its inking, between a forward position and a return position, a pad-holder carriage likewise mounted for horizontal movement between an impression-taking return position and a forward printing position, and control means designed to control the horizontal movements of said carriages.

In the GB Pat. No. 907,109 the control means designed to control the horizontal movements of the plate-holder carriage are separate from those means designed to control the horizontal movement of the pad-holder carriage.

In practice, in either case it is a matter of pneumatic actuators, the actuations of which have to be synchronised.

The result of this is a general control which is relatively complicated, expensive and not very reliable.

In the aforementioned GB Pat. No. 911.534, the control means common to the plate-holder and pad-holder carriages comprise a gearwheel meshing respectively with a rack attached to one carriage and with another rack attached to the other carriage, the drive being derived from an actuator coupled to one carriage.

An arrangement of this type results in noisy operation; moreover, in view of the necessary play in operation, particularly at the level of the racks, the degree of precision attained is not very high.

The present invention generally has the object of providing a single control for the plate-holder carriage and pad-holder carriage.

More precisely, the invention relates to a printing machine of the above-mentioned type having control means designed to control the horizontal movement of the plate-holder carriage and of the pad-holder carriage, these means being common to both these carriages, a machine of this type being characterised in that said control means comprise a control rod which is pivotally mounted on a fixed axis and forms two arms on either side of said axis, a control member, for example a pneumatic actuator or ram, which imparts to the control rod a pivotal reciprocating motion about said fixed axis, and two links each of which is respectively articulated, on the one hand, at one of the arms of the control rod and, on the other hand, at one of the plate-holder and pad-holder carriages.

Accordingly, only a single control member, in this instance a pneumatic actuator, is required to control the horizontal movements of the plate-holder carriage and of the pad-holder carriage, and by means of the control rod and the links used this control is advantageously effected in positive manner, without appreciable play.

According to a development of the invention, the pneumatic actuator also ensures the control of the movements necessarily carried out by the doctor and doctor support for inking the printing plate.

Therefore, according to the invention, the horizontal movements of the plate-holder carriage and pad-holder carriage and the movements of the doctor and doctor support are advantageously synchronised in relation to one another directly by the single pneumatic actuator, from which they are derived.

The result of this is a combined control which is simple, of reasonable cost price and reliable and safe in operation.

The features and advantages of the invention will become apparent from the description below, given by way of example, with reference to the accompanying diagrammatic drawings, in which.

Figure 1:
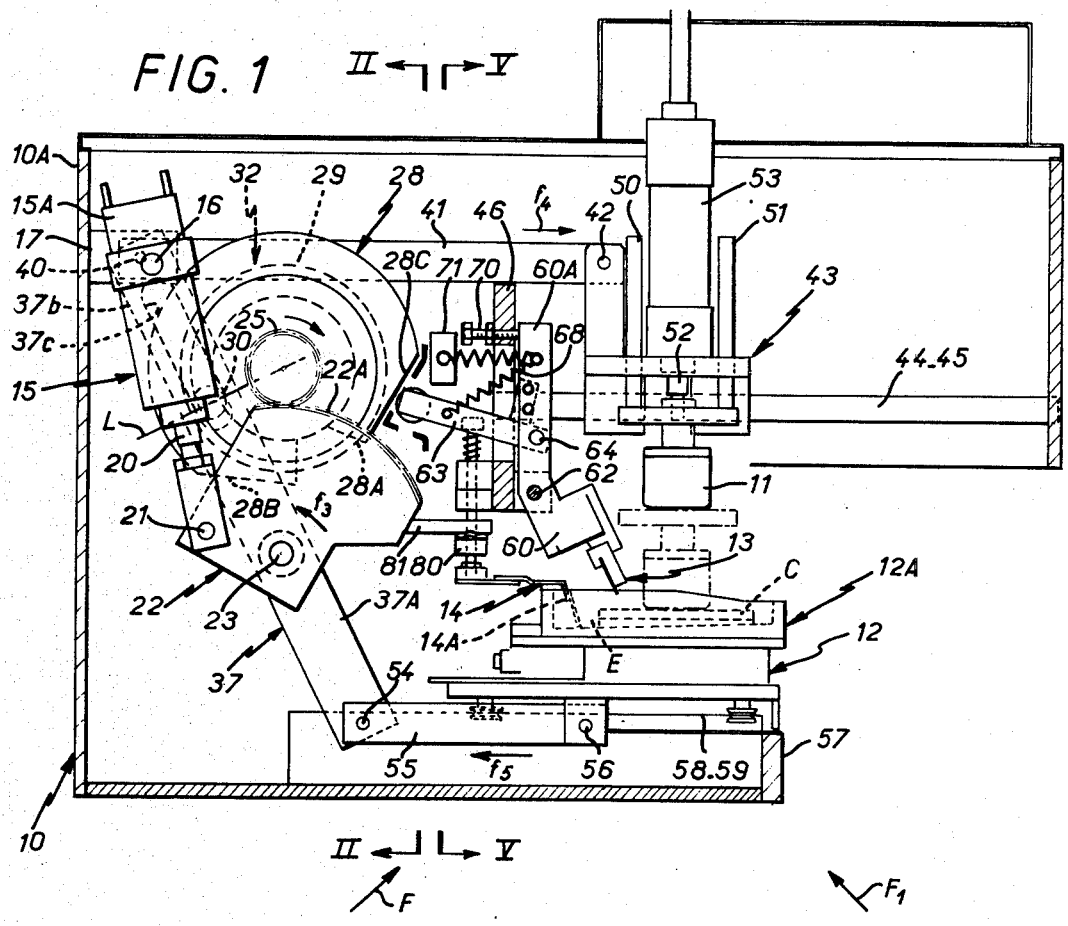
FIG. 1 is an elevation of a printing machine according to the invention, in which it is assumed that one side of the housing is omitted.
Figure 2:
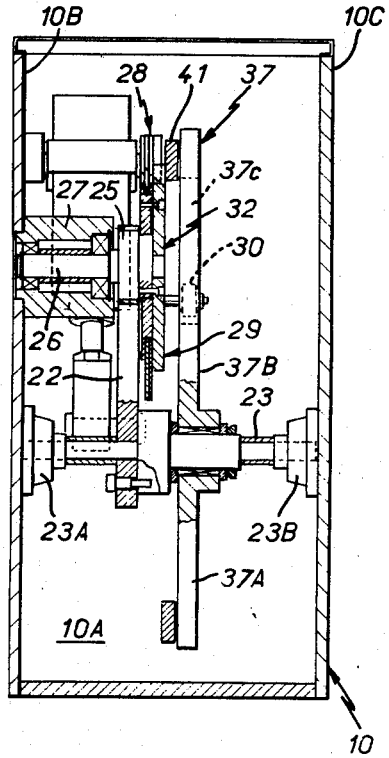
FIG. 2 is cross-sectional view of this machine, taken along the line II—II in FIG. 1.
Figure 8:
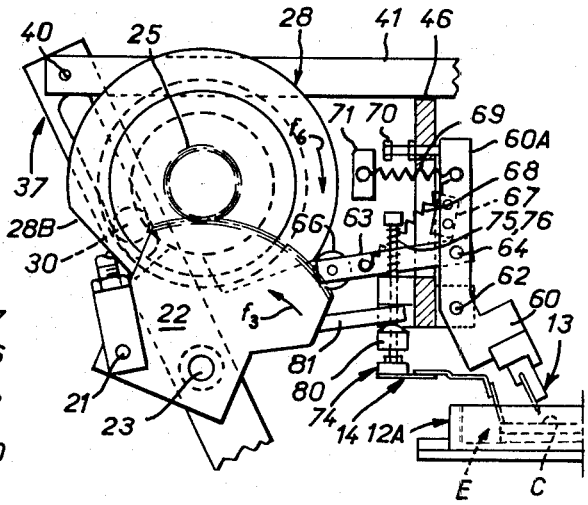
Figure 9:
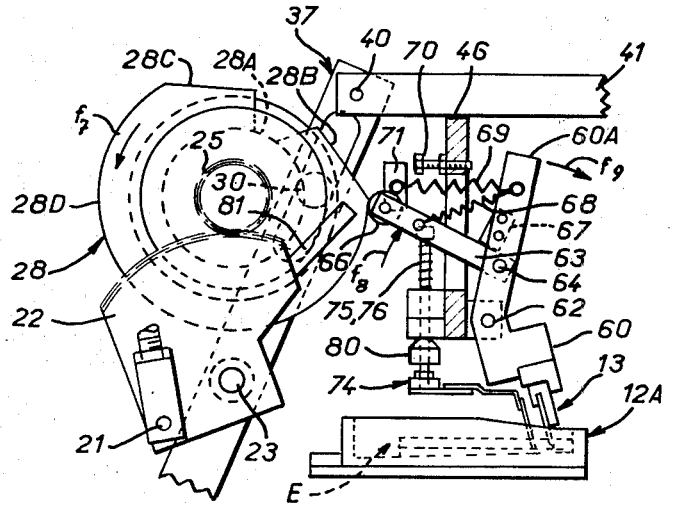
Figure 6:
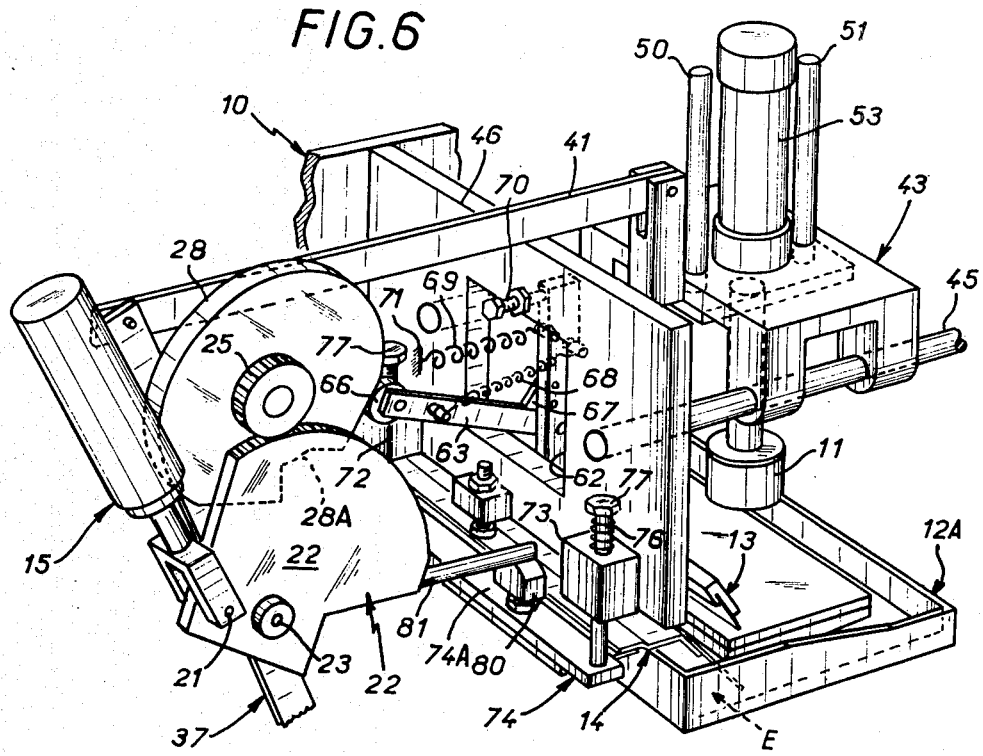
FIGS. 6 and 7 are partial views in perspective of the machine according to the invention, respectively in the direction of the arrows F, F1 indicated in FIG. 1.
Figure 7:
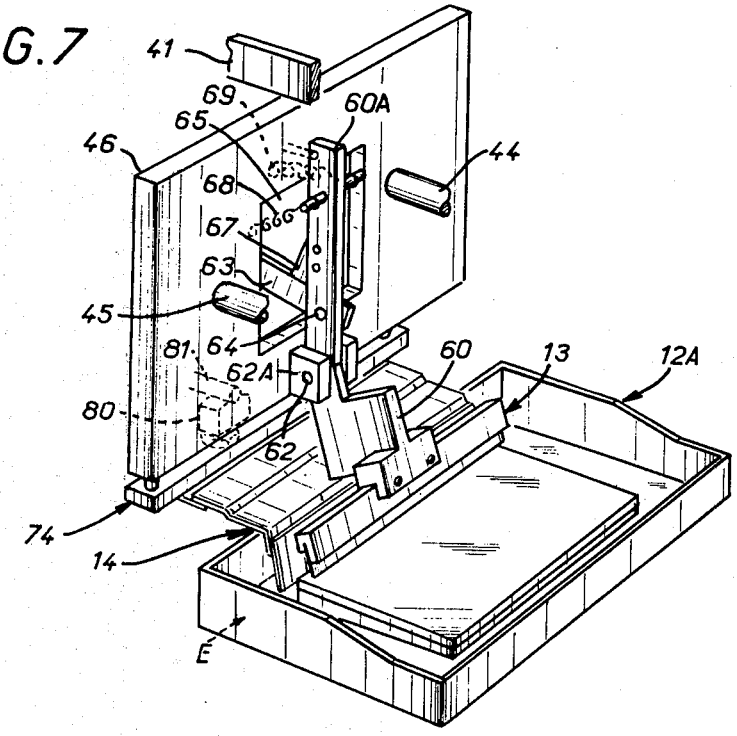
Figure 10:
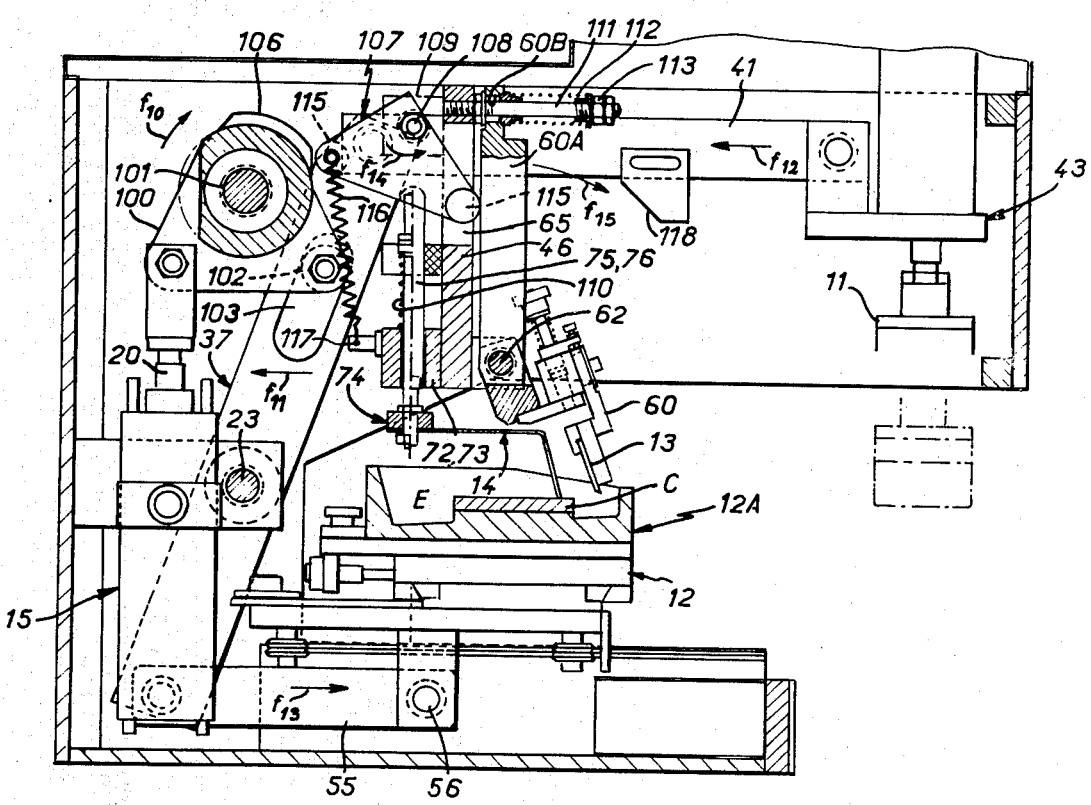

FIGS. 8 and 9 partly depict FIG. 1 and illustrate two further operating stages of the machine according to the invention;

FIG. 10 is a similar view to that in FIG. 1 and relates to a variant of embodiment.

According to the embodiment illustrated in FIGS. 1 to 9, the printing machine of the invention comprises, arranged in a housing 10, a printing pad 11 movable both horizontally and vertically, a horizontally movable plate-holder carriage 12, a doctor 13 swinging in a vertical plane and a doctor support 14 movable in a vertical plane.

The aforementioned members are controlled by means of a single control member, for example an actuator 15, preferably of the pneumatically operated type, whose cylinder 15A is mounted to swing about an pivot 16 supported by mountings 17 attached to one side 10A of the housing 10.

The piston rod 20 of the aforesaid actuator is connected by a pivot 21 to a toothed segment 22 mounted to swing about a fixed transverse shaft 23 carried by bearings 23A, 23B attached to the sides 10B, 10C of the housing.

The teeth 22A of the toothed segment 22 mesh with a gearwheel 25 keyed on to a pin 26 pivotally mounted in a bearing 27 fixed to the side 10B of the housing.

On the aforementioned pin 26 are also keyed, on the one hand, a cam 28 having on its periphery a recess 28A opening on to two flats 28B, 28C and, on the other hand, a disc 29 carrying a roller 30, the assembly of disc 29 and roller 30 forming a crank indicated as a whole by 32.

The operation of the cam 28 will be described later.

A control rod 37 is pivotally mounted about the shaft 23 and has one arm 37A substantially shorter than the other arm 37B.

The crank 32 is connected by a sliding assembly to the longer arm 37B of the control rod 37; for this purpose the arm 37B comprises a longitudinal cavity 37C forming a slot in which the roller 30 of the crank 32 is fitted and is able to move therein. The control rod 37 is coupled by its larger arm 37B and by means of a pivot 40 to one end of a first link 41, the other end of which is connected by a pivot 42 to a pad-holder carriage indicated as a whole by 43 and capable of translational movement along guides 44, 45 which, on the one hand, are carried by the housing 10 and, on the other hand, by a bracing plate 46.

The printing pad 11 is connected to an assembly comprising two guides 50, 51 able to slide vertically in the carriage, this assembly itself being connected to the piston rod 52 of an actuator 53 which extends vertically; the printing pad 11 is thus able to move horizonally on the rails 44, 45 and also between a top position and bottom position.

The other arm 37A of the control rod 37 is connected by pivot 54 to one end of a second link 55, the other end of which is connected by a pivot 56 to the carriage 12 holding the printing plate C, this carriage itself being arranged for translational movement along rails 58, 59 carried by a base 57.

The plate-holder carriage 12 is thus capable of translational movement horizontally between a forward position and a return position.

It should be noted that the different lengths of the arms 37A, 37B of the control rod cause the travel of the pad-holder carriage 43 to be a multiple of the travel of the plate-holder carriage 12, when the rod 37 is driven in pivotal motion about its fixed pivot 23.

Moreover, it will be observed that for at least one of the end positions in the pivoting of the rod 37 about its fixed pivot 23, the crank 32 is substantially perpendicular to this control rod, as illustrated for one end position of the rod 37 by the broken line L in FIG. 1.

Preferably, in each of the end positions of the rod 37 the crank is perpendicular to said rod, the broken line L' (FIG. 3) indicating the other end position of the crank 32 and thus of the rod 37.

An arrangement of this type has the advantage of enabling the moving parts to operate without shocks or jerks and, therefore, very smoothly, owing to the fact that the respective speeds of translational movement of the pad-holder carriage 43 and plate-holder carriage 12 are of sinusoidal type. i.e. starting practically from zero to reach a maximum and then returning practically to zero.

The printing machine according to invention is completed by a system comprising doctor 13 and doctor support 14 which are disposed substantially between the pad-holder carriage 12 and the cam means 28 and crank means 32.

The doctor/doctor support system (see in particular FIGS. 6 and 7) is carried by the bracing plate 46 and on the side facing the pad holder it comprises a carrier 60 arranged to carry at its lower end the doctor 13 in the form of a transverse blade, and to pivot about a fixed pivot 62 carried by a flange 62A attached to the bracing plate 46.

The carrier 60 for the doctor 13 is extended upwards at 60A and in a central part it receives a lever 63 pivotally mounted about a pivot 64 in extending on the other side of an aperture 65 provided in the bracing plate 46; at its free end this lever carries a roller 66 intended to cooperate with the cam 28.

This doctor carrier 60 also carries on its part 60A a fixed stop member 67 againt which the lever 63 is applied by means of a return spring 68.

Another return spring 69 tends to urge the carrier 60 for the doctor 13 into a rest position against an adjustable stop member 70 carried by the bracing plate 46, this other spring being attached by one end at the top of said carrier and by its other end to a fixed point indicated at 71.

The other side of the bracing plate 46, facing the crank 32 and the cam 28, comprises at the bottom two slides 72, 73, with vertical axes, in which can slide the vertical arms of a stirrup 74 against the force of return springs 75, 76 (see also FIG. 5) held captive between the slides and stop nuts 77 screwed to the end of each of said vertical arms.

The horizontal arm 74A of the stirrup 74 carries on one side the doctor support 14 and on the other side a vertically adjustable stud 80 intended to cooperate with a finger 81 attached to the toothed segment 22.

In FIG. 1 the actuator 15 is in a retracted position so that by means of the control rod 37 the carriage 43 carrying the printing pad 11 is vertically above the carriage 12 carrying the printing plate C; by way of a reciprocating motion under the action of the actuator 53 it is possible for the printing pad 11 to take an impression upon coming into contact with the plate C.

Since the cam 28 is not acting on the lever 63, the carrier 60 for the doctor 13 is in its upper position, whilst the finger 81 attached to the toothed segment 22 exerts a downward thrust on to the doctor support 14, so that the end part 14A of this latter is immersed in a portion E of the ink unit 12A mounted on the plate-holder carriage 12.

When the printing pad 11 has taken an impression and has returned to its upper position, pressure is supplied to the actuator 15, which has the result of starting an operating cycle which takes place as follows:

the toothed segment 22 imparts through the crank 32 pivotal motion to the control rod 37 about the fixed shaft 23, which results in simultaneous translational movements of the pad-holder carriage 43 and the plate-holder carrier 12 in opposite directions of movement (in FIG. 1 the arrows f3, f4, f5 indicate respectively the direction of movement of the toothed segment 22, of the link 41, of the link 55; it will be noted that during the pivoting of the control rod 37 between its two end positions, the links 41, 55 likewise pivot about the pivots 42, 56 connecting them respectively to the carriage 43 and to the carriage 12;

simultaneously (FIG. 8) at the start of the cycle, the finger 81 attached to the toothed segment 22 releases the stirrup 74 carrying the doctor support 14 which thus returns automatically to the upper position under the action of springs 75, 76, so that the free end thereof is at the same level as the plate C so as to ink the latter, whereas the cam 28, caused to rotate in the direction of arrow f6, induces the lever 63 to tilt, this tilting having no effect on the carrier 60 of the doctor 13 which remains in its upper position, i.e. removed from the surface of the printing plate.

It is to be noted that during the transfer of the printing pad 11 from its location for taking an impression at the doctored plate C to its printing location, the plate C is inked during the displacement of the carriage 12 by the end 14A of the doctor support 14 released by the finger 81 and returned to the upper position by the springs 75, 76; the upper position of the doctor support being such that the free edge thereof licks the surface of the printing plate and thus inks it.

Figure 3:
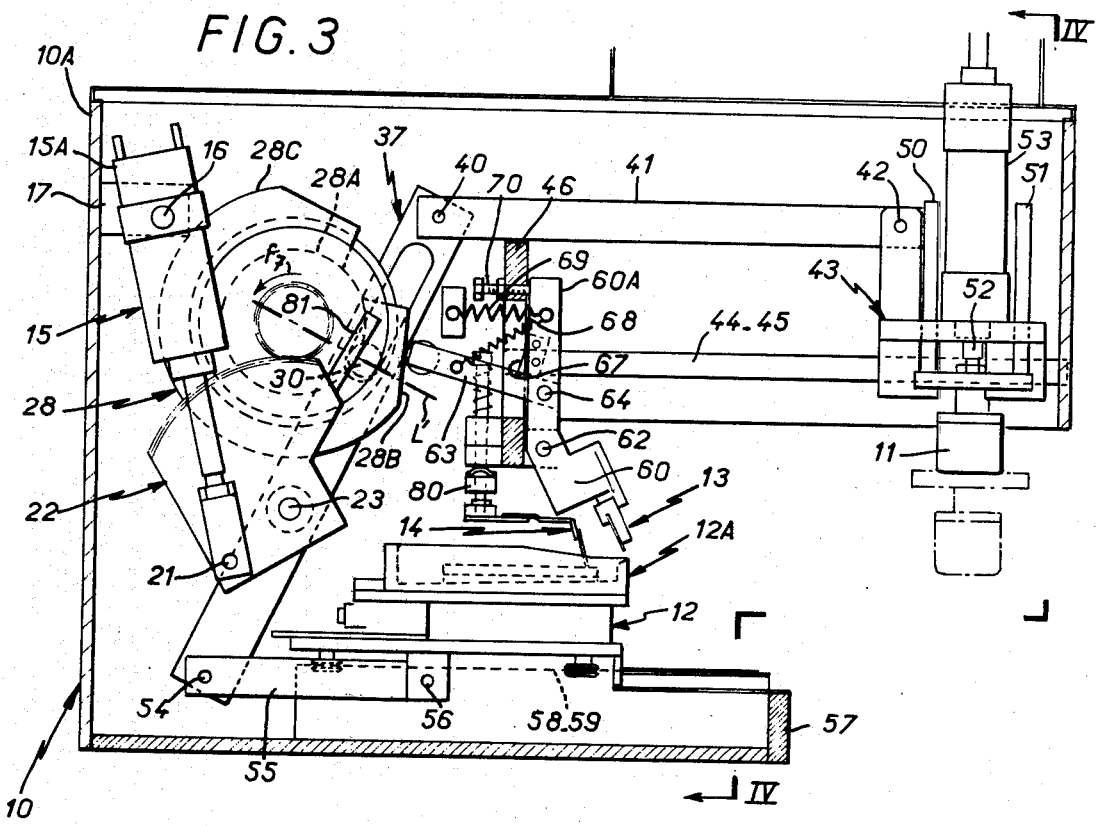
FIG. 3 is a similar view to FIG. 1, for another operating stage of the machine according to the invention.
Figure 4:
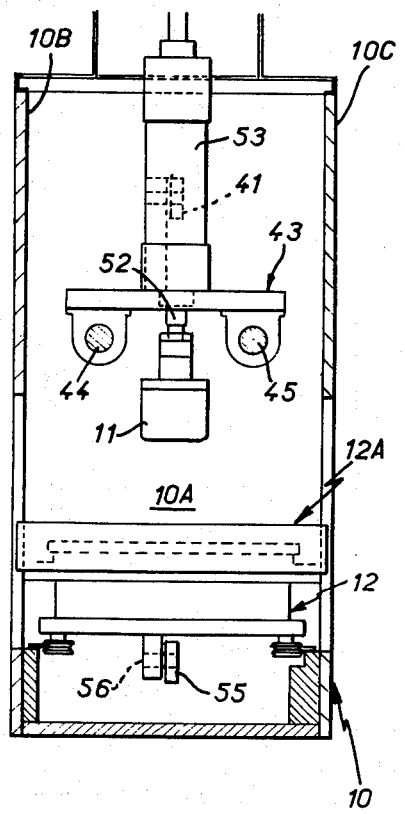
FIG. 4 is a cross-sectional view taken along the line IV—IV in FIG. 3.
Figure 5:
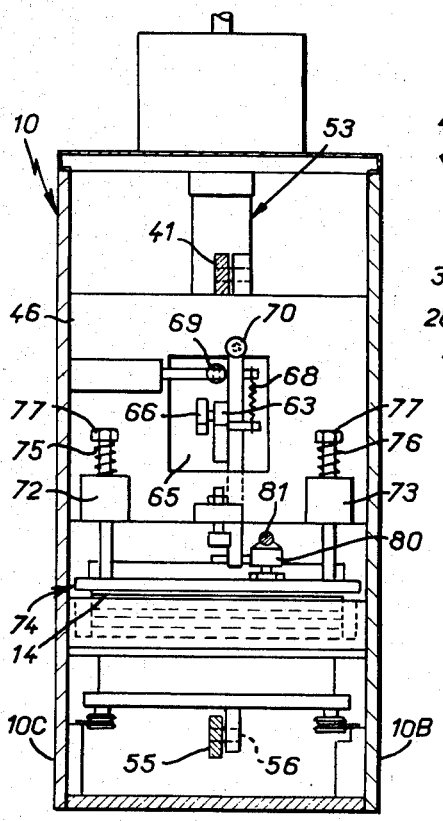
FIG. 5 is also a cross-sectional view taken along the line V—V in FIG. 1.

FIG. 3 illustrates the position of the various conponents of the machine at the end of travel of the actuator 15, wherein it is evident that the flat 28B of the cam 28 has allowed the lever 63 to pivot about its pivot 62 under the infuence of the return spring 68 and to resume contact with the stop member 67, where it is situated in an upper rest position.

When the printing pad 11 has carried out a printing operation by vertical reciprocating movement at the printing station and by means of the actuator 53, the actuator 15 is restored to its initial position, which has the effect of simultaneously displacing the pad-holder carriage 43 and plate-holder carriage 12 in opposite directions to those previously indicated with f4,f5, but also of bringing into action the doctor 13 to doctor the plate C.

In fact, from the start of rotation of the cam 28 (arrow f7 in FIGS. 3 and 9) the contour of this latter causes the lever 63 to tilt upwards in the direction of arrow f8; now as the lever 63 is in contact with the stop member 67 attached to the carrier 60 it is urged to swing (arrow f9) about the pivot 62 connecting it to the bracing plate 46.

The doctor 13 is thus brought and held in contact with the surface of the plate C during the translational movement of this latter, by cooperation of the roller 66 mounted on the lever 63 with a circular crown 28D provided on the cam 28.

The doctor support 14 is itself maintained in the upper position during the doctoring phase.

In the fully retracted position of the actuator 15, the cam 28 releases the lever 63 and thus the carrier 60 when the flat 28C is positioned in front of this lever; this latter is thus returned into its rest position under the action of the return spring 69.

Since all the components are once more in the position illustrated in FIG. 1, a new cycle may commence and so on.

Reference will now be made to FIG. 10 showing a variant of embodiment in which the same reference numerals are use to designate like parts.

According to this variant, the piston rod 20 of the actuator 15 is coupled to a linkage 100 pivotally mounted on a shaft 101; this linkage 100 is of generally triangular shape and one of its apices is provided with a roller 102 designed to slide in a slot 103 provided in the main control rod 37 pivotally mounted on a fixed shaft 23 and coupled at its ends, as previously, to a first link 41 connected to the carriage 43 carrying the printing pad 11 and to a second link 55 connected to the carriage 12 carrying the plate C.

On the aforesaid shaft 101 there is likewise keyed a cam 106 designed to cooperate with a generally triangular lever 107 pivotally mounted on an a pivot 108 supported by a bearing 109 attached to the bracing plate 46, this latter having an aperture 65.

The side of the bracing plate 46 facing the control rod 37 comprises two slides 72, 73 in which can slide the arms 75, 76 of a stirrup 74 on the bottom part of which is mounted the doctor support 14, these arms being constantly urged to return upwards by means of the springs 110 fitted to the aforesaid arms.

On the side of the bracing plate 46 facing the pad-holder carriage 43, the carrier 60 for the doctor 13 comprises at the top a passage 60B into which fits with clearance a pin 111 carried by said bracing plate 46; a compression spring 112 is fitted on to the pin 111 and has one end in contact with the upper part of the carrier 60 and the other end in contact with nuts 113 screwed on to the pin, so that the carrier 60 is constantly urged resiliently against the bracing plate 46.

The lever 107 is in contact with the cam 106 by way of a roller 115 and through the aperture 56 it is also in contact with the part 60A of the carrier 60 by means of a spring 116 attached at one end to said lever and at the other end to a fixed point 117 provided on the bracing plate 46.

In this embodiment the link 41 carries a ramp 118 designed to cooperate with one end of an arm, for example the arm 75 of the stirrup 74.

In FIG. 10 the various components of the machine are illustrated in positions which correspond to an operating stage in which the printing pad 11 may perform a printing operation.

When the actuator 15 is supplied with pressure, the piston rod 20 drives the linkage 100 about the shaft 101 in the direction of arrow f10, which has the result of:

causing the control rod 37 to pivot about its fixed pivot 23 in the direction of arrow f11 and, therefore, imparting translational movement to the pad-holder carriage 43 in the direction of arrow f12, whereas the carriage 12 carrying the plate C undergoes translational movement in the direction of arrow f13;

causing the lever 107 to swing (arrow f14) under the influence of the cam 106 about its pivot 108, which causes the pivoting (arrow f15) of the carrier 60 about is axis 62; the doctor 13 comes into contact with the plate C under the influence of this swinging motion.

When the piston rod 20 of the actuator 15 reaches its end position, the pad-holder carriage 43 is at right angles with the carriage 12 carrying the plate C, whilst the cam 106 has released the lever 107 thus allowing the carrier 60 to return to its rest position and to locate the doctor 13 in its upper inoperative position, whereas the ramp 118 acting on the arms of the stirrup 74 imparts to this latter a downward movement so that the end portion of the doctor support 14A is immersed in the ink unit E.

A new cycle may be commenced and so on.

Of course the invention is not restricted to the embodiments chosen and illustrated here but, on the contrary, it may undergo various modifications without thereby departing from the scope of the present invention.

I claim:

1. A pad transfer printing machine comprising a plate-holder carriage, means for mounting said plate-holder carriage for horizontal movement for inking a printing plate between a forward position and a return position, a pad-holder carriage, means for mounting said pad-holder carriage for horizontal movement between an image-receiving return position and a forward printing position, common control means for controlling the horizontal movements of both of said carriages, said common control means comprising a control rod pivotally mounted above a fixed pivot and defining a pair of arms extending respectively to opposite sides of said pivot, a pneumatic actuator for imparting pivotal reciprocating movement to said control rod about said fixed pivot, two links pivotally connected to said control rod arms respectively, one of said links being pivotally connected to one of said control rod arms and said plate-holder and the other of said links being pivotally connected to the other of said control rod arms and said pad holder.

2. A printing machine according to claim 1, wherein said pneumatic actuator comprises a cylinder and a piston, a selected one of said piston and cylinder being pivotally mounted relative to another fixed pivot, the nonselected one of said piston and cylinder being pivotally connected to a toothed segment, said toothed segment meshing with a gearwheel, and a crank pin fixed to said gearwheel and in sliding engagement in a guideway in said control rod.

3. A printing machine according to claim 2, wherein a crank defined by said crank pin and said gearwheel being substantially perpendicular to said control rod in at least one end pivot position of said control rod.

4. A printing machine according to claim 1, wherein said pneumatic actuator comprises a cylinder and a piston, a selected one of said cylinder and piston being pivotally connected to a linkage component, said linkage component being pivotally mounted about another fixed pivot and in sliding engagement in a guideway in said control rod.

5. A printing machine according to claim 1, wherein said control rod arms are of different length so that the stroke of said pad-holder carriage is proportionally greater than the stroke of said plate-holder carriage.

6. A printing machine according to claim 1, further comprising a doctor blade supported on a doctor carrier pivotally mounted about a horizontal axis and spring biased toward a fixed stop member, said pneumatic actuator being operatively connected to said doctor carrier for pivoting the same.

7. A printing machine according to claim 2, wherein a doctor blade is supported on a doctor carrier pivotally mounted about a horizontal axis and spring biased toward a fixed stop member, said pneumatic actuator being operatively connected to said doctor carrier for pivoting the same, and a cam connected for rotation with said toothed segment cooperating with a finger pivotally connected to said doctor carrier, a spring urging said finger toward another stop member carried by said doctor carrier, whereby for one direction of rotation of said cam, said cam is inoperative with respect to said doctor carrier since said finger is urged resiliently away from said other stop member, whereas for an opposite direction of rotation said cam urges said finger against said stop member, thereby causing said doctor carrier to pivot.

8. A printing machine according to claim 4, comprising a doctor blade supported on a doctor carrier pivotally mounted about a horizontal axis and spring biased toward a fixed stop member, said pneumatic actuator being operatively connected to said doctor carrier for pivoting the same, a cam connected for rotation with said linkage component cooperating with a lever pivotally mounted at a fixed point for acting against another point on said doctor carrier for controlling the pivoting of said doctor carrier.

9. A printing machine according to claim 2, further comprising a doctor support carried by a doctor support carrier movable vertically against resilient return means urging said doctor-support toward a raised position, said doctor-support carrier being movable downward in response to said pneumatic actuator.

10. A printing machine according to claim 9, wherein a finger attached to said toothed segment cooperates with said doctor-support carrier for controlling its downward movement.

11. A printing machine according to claim 8, wherein an inclined plane attached to one of said links cooperates with said doctor-support carrier for controlling its downward movement.

* * * * *